US005577950A

United States Patent [19]

Smith et al.

[11] Patent Number: 5,577,950

[45] Date of Patent: Nov. 26, 1996

[54] CONFORMAL TOOL OPERATING APPARATUS AND PROCESS FOR AN OPHTHALMIC LENS FINER/POLISHER

[75] Inventors: Kenneth L. Smith, Porum; Stephen Kulan, Muskogee, both of Okla.

[73] Assignee: Coburn Optical Industries, Inc., Tulsa, Okla.

[21] Appl. No.: 158,918

[22] Filed: Nov. 29, 1993

[51] Int. Cl.[6] ..... B24B 1/00

[52] U.S. Cl. ..... 451/42; 451/270; 451/277; 451/59; 451/526; 451/384

[58] Field of Search ..... 451/11, 12, 13, 451/42, 323, 325, 384, 385, 390, 398, DIG. 921, 270, 271, 277, 278, 526, 59

[56] References Cited

U.S. PATENT DOCUMENTS

| | | | |
|---|---|---|---|
| 3,144,737 | 8/1964 | Faas | 451/42 |
| 4,274,232 | 6/1981 | Wylde | 451/921 |
| 4,733,502 | 3/1988 | Braun | 451/42 |
| 4,962,618 | 10/1990 | Wylde | 451/921 |
| 5,024,024 | 6/1991 | Watanabe | 451/42 |
| 5,205,083 | 4/1993 | Pettibone | 51/284 R |

FOREIGN PATENT DOCUMENTS

| | | |
|---|---|---|
| 054368 | 6/1982 | European Pat. Off. . |
| WO-A-8909680 | 10/1989 | France . |
| 1234572 | 2/1967 | Germany . |
| 2050884 | 1/1981 | United Kingdom . |
| 2050884B | 3/1989 | United Kingdom . |

*Primary Examiner*—D. S. Meislin
*Assistant Examiner*—Eileen Morgan
*Attorney, Agent, or Firm*—Frank J. Catalano; Scott R. Zingerman

[57] ABSTRACT

A tool for fining/polishing an opthalmic lens has a spindle and a pliant casing containing a conformable filler connected to the spindle for rotation therewith. A pliant pad adhered to the casing has a plurality of slots extending from its perimeter toward its center defining a plurality of fingers which are contoured to the surface of the lens by the filler.

Preferably, the lens is rotated about a vertical fixed axis substantially transverse to the lens and the tool is rotated about a fixed axis intersecting the lens and substantially normal to a surface of the lens to be fined/polished with the tool disposed above the lens. The axis of the horizontal displacement of the tool can be selectively varied in relation to the lens axis. The angular disposition of the tool axis in relation to the lens axis can be selectively varied. The radial displacement of the tool in relation to the lens along the tool axis can be selectively varied to bring the pad into and out of abutment with the surface of the lens and to vary the pressure exerted on surface of the lens by the tool.

22 Claims, 12 Drawing Sheets

CONFORMAL TOOL OPERATING APPARATUS AND PROCESS FOR AN OPHTHALMIC LENS FINER/POLISHER

BACKGROUND OF THE INVENTION

This invention relates-generally to processes and equipment for fining and polishing ophthalmic lenses and more particularly concerns conformal tools and the processes and apparata associated in the operation thereof.

The ability to accurately grind ophthalmic lenses to asymmetrical geometries specifically suited to the individual is relatively new in the ophthalmic lens industry. As a result, little work has been done in the development of fining and polishing tools to increase the accuracy of the fining/polishing operation.

In the past, fining/polishing tools provided a global conformance to the lens. That is, a separate tool was used for every possible contour of lens and, for each lens, the proper tool had to be selected and mounted on the fining/polishing apparatus. However, the recent development of more accurate lens surfacing equipment mandates improvement in the fining/polishing equipment since presently known fining/polishing equipment would damage the accurate geometries made possible by the new equipment. With the advent of improved lens conforming equipment, modern lenses exhibit wide variations in face curvature. For example, in aspheric lenses, in the progression in length of radius to the curvature of the lens face, the radius to the extremity of the lens is normally greater than the radius to the center of the lens so that the lens flattens towards its extremities. However, in modern lenses, the progression may be decreasing and/or increasing so that the face of the lens might change from a convex to a concave and back to a convex condition. Fining/polishing such a lens with presently known equipment generally results in the loss of the correct geometry of the lens. Furthermore, while spherical and aspherical lenses are generally rotationally symmetrical, progressive and toric lenses can now be ground which do not meet this condition. While some work has been done in the development of conformal tools which can be used to fine/polish a variety of symmetrical, spherical and aspherical lenses, no equipment has been presently developed which will permit a single or minimal number of fining/polishing tools to conform to all contours of lenses including toric lenses.

While some conformal tool development work has been done, no such tool is presently available which is not progressively incremented. That is, conformance is accomplished in incremental diopter ranges so that the tool does not accurately conform progressively at any position of a lens contour. Thus, the fining/polishing process can adversely effect the accuracy of the lens geometry.

One presently known conformal tool employs air pressure under the control of the operator in the conformal tool to control the degree of conformance to the lens. However, the use of air pressure or hydraulic pressure under operator control introduces inaccuracy into the system. In addition, the face of the tool tends to buckle and lose its integrity with the lens surface, introducing further error into the system. In addition, the tool is oriented so that the lens to be fined/polished is above the tool. As a result, gravitational pulls cause further problems with both the tool and the polishing medium. Furthermore, while the tool is mounted on a fixed axis, the lens is mounted on a floating axis, permitting a flopping action between the lens and the finer/polisher, causing further problems in accuracy and also damage to the finer/polisher. In fact, the finer/polisher is required to be greater than half the diameter of the lens or the lens would drop off the tool should it oscillate past the tool center. Also, in one known conformal tool, while the tool rotation is controlled with respect to both rotating rpm and orbital rpm, the lens is rotated at a multiple of the tool rotation and the lens rotational speed is not otherwise controllable. This restricts control of the abrasive aggressiveness of the device.

Other problems with known conformal tools include the requirements of alignment or coincidence of the center line of the tool with the center line of the lens, resulting in lower angular velocities being focused toward the center line and higher angular velocities being focused outwardly therefrom, causing a distortion of the lens. Perhaps most significantly, even in known conformal tools, conformance to the lens is still global rather than local.

It is, therefore, an object of this invention to provide a fining/polishing tool affording greater local conformance than has been heretofore available. It is also an object of this invention to provide a fining/polishing tool having computer controlled parameters of operation that may be varied and optimized based on selection of lens material and geometry. Another object of this invention is to provide a conformal tool which resists buckling and maintains its integrity in conformance to the lens. Another object of this invention is to provide a conformal tool that does not require parallel or coincident arrangement of the tool and lens axes of rotation. Still another object of this invention is to provide a conformal tool that does not require pneumatic or hydraulic pressure to achieve conformance to a lens. Yet another object of this invention is to provide a conformal tool which is usable for both fining and polishing. Another object of this invention is to provide a conformal tool operating apparatus which does not require that the tool be greater than one-half the diameter of the lens. Another object of this invention is to provide a conformal tool operating apparatus which requires no operator manual control during its operation. It is a further object of this invention to provide a conformal tool operating apparatus which facilitates variation in the angular alignment of the tool axis in relation to the lens axis. It is a further object of this invention to provide a conformal tool operating apparatus which facilitates the transverse displacement of the tool in relation to the rotational axis of the lens.

SUMMARY OF THE INVENTION

In accordance with the invention, a tool for fining/polishing an ophthalmic lens is provided having a spindle and a pliant casing containing a conformable filler, the casing being connected to the spindle for rotation therewith. A pliant pad adhered to the casing to rotate therewith has a plurality of slots extending from a perimeter toward a center thereof defining a plurality of fingers therebetween. The filler contours the pad and the fingers thereof to a surface of the lens to be fined/polished.

The pad is connected to the tool by use of a disc connected to the spindle and a ring, the casing having a flange about a rim thereof which is clamped between the disc and the ring. A pliant cover is also clamped between the disc and the flange. Preferably, two discs will be used with the first disc connected to the spindle and a second disc connected to the casing, the second disc having an eccentric bore for snugly receiving the first disc therein. Thus rotation of the second disc in relation to the first disc varies the eccentricity of the second disc in relation to the spindle. A set screw secures the second disc against rotation relative to the first disc to maintain a selected eccentricity. The lens is rotated about a fixed axis substantially transverse to the lens. Preferably, the lens axis is substantially vertical. The tool is rotated about a fixed axis intersecting the lens and substantially normal to a surface of the lens to be fined/polished, preferably with the tool being disposed above the lens. The axis of the horizontal displacement of the tool can be selectively varied in relation to the lens axis. In addition, the angular disposition of the tool axis in relation to the lens axis can be selectively varied. Finally, the radial displacement of the tool in relation to the lens along the tool axis can be selectively varied to bring the pad into and out of abutment with the surface of the lens and to vary the pressure exerted on surface of the lens by the tool. A slurry nozzle directs a fining/polishing fluid onto the surface of the lens and a rinse nozzle directs a rinsing fluid onto the surface of the lens. The lens rotating speed is adjustable as is the tool rotating speed. A computer controls the operation of the tool. The computer controlled process includes the steps of:

initiating flow of fining/polishing fluid from the slurry means onto the lens surface to be fined/polished;

initiating rotation of the lens about the lens axis;

initiating rotation of the tool about the tool axis;

aligning the angular disposition of the tool axis to be substantially normal to the surface of the lens at a desired point of intersection of the tool axis with the lens surface;

displacing the tool axis horizontally in relation to the lens axis to bring the angularly aligned axis into intersection with the lens surface at the desired point;

displacing the tool radially along the angularly aligned and horizontally displaced axis to bring the pad into abutment with the lens surface at a desired pressure to fine/polish the lens surface; and withdrawing the tool radially along the angularly aligned and horizontally displaced axis after a preselected fining/polishing period.

The process may further include the steps of:

stopping the flow of fining/polishing fluid from the slurry means;

stopping rotation of the tool about the tool axis;

displacing the tool axis horizontally in relation to the lens axis to distance the tool from the lens surface;

initiating flow of rinse fluid from the rinse means onto the lens surface;

stopping flow of the rinse fluid from the rinse means;

continuing rotation of the lens for a preselected drying period; and stopping rotation of the lens about the lens axis after the preselected drying period.

A compartment enclosing the tool and the lens has a drain in a bottom portion thereof for discharging the fining/polishing and rinsing fluids. A valve receiving fluid discharged form the drain switches flow of the discharged fluid between two discrete outlet paths. The valve is controlled by the computer to switch to one of the outlets before initiating flow of the fining/polishing fluid and to switch to the other outlet before initiating flow of the rinsing fluid.

BRIEF DESCRIPTION OF THE DRAWINGS

Other objects and advantages of the invention will become apparent upon reading the following detailed description and upon reference to the drawings in which.

While the invention will be described in connection with preferred embodiments and processes, it will be understood that it is not intended to limit the invention to those embodiments and processes. On the contrary, it is intended to cover all alternatives, modifications and equivalents as may be included within the spirit and scope of the invention as defined by the appended claims.

DETAILED DESCRIPTION

Figure 1:
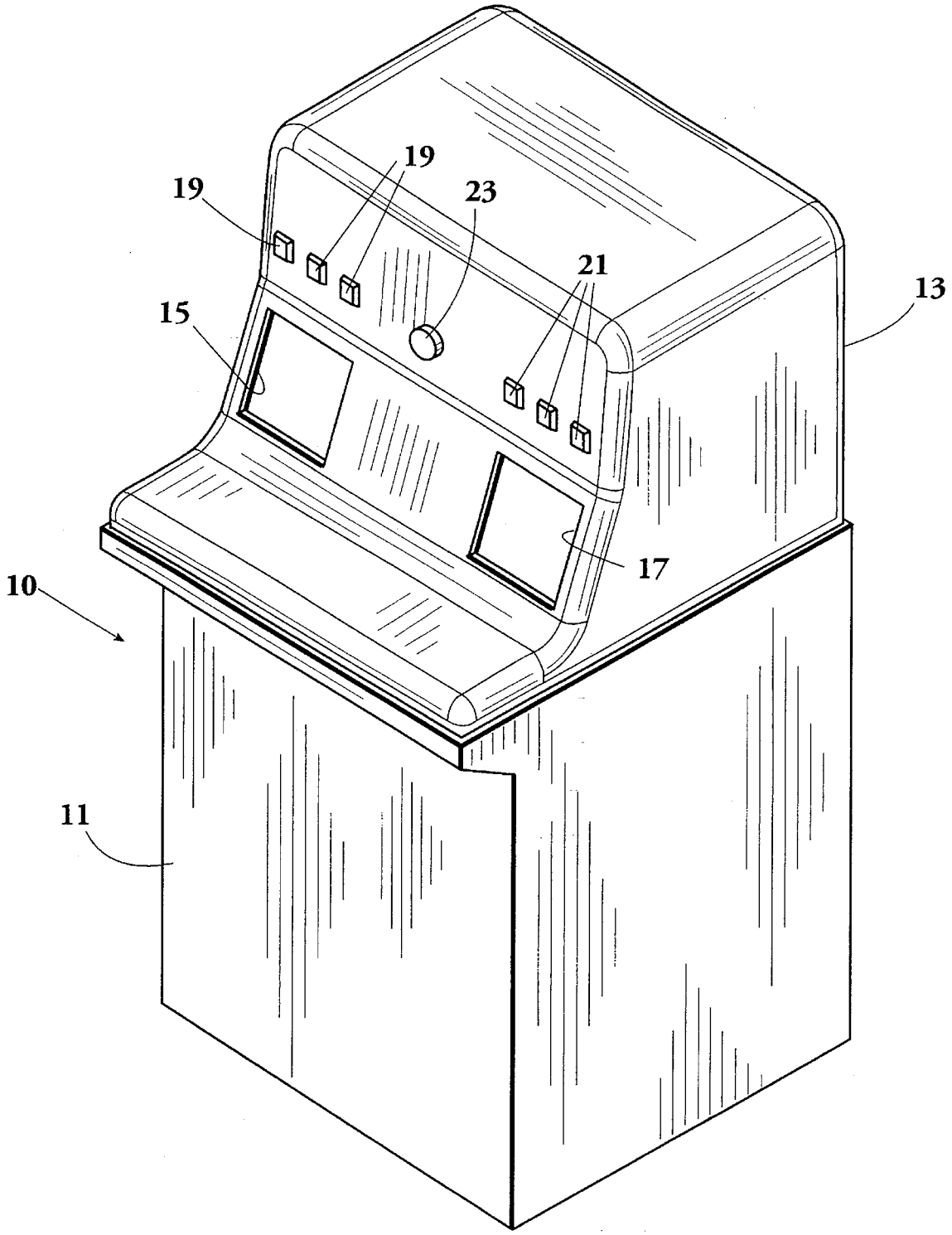
FIG. 1 is a perspective view of a preferred embodiment of a finer/polisher console.

Looking first at FIG. 1, a preferred embodiment of a console 10 for the conformal tool has a lower cabinet 11 and a removable upper cover 13 with left 15 and right 17 openings in its front face for access to separate fining/polishing compartments which will each contain conformal tools. Extending through the front face of the cover 13 are two sets of push buttons 19 and 21 and an emergency stop button 23, the purposes of which will hereinafter be explained.

Figure 2:
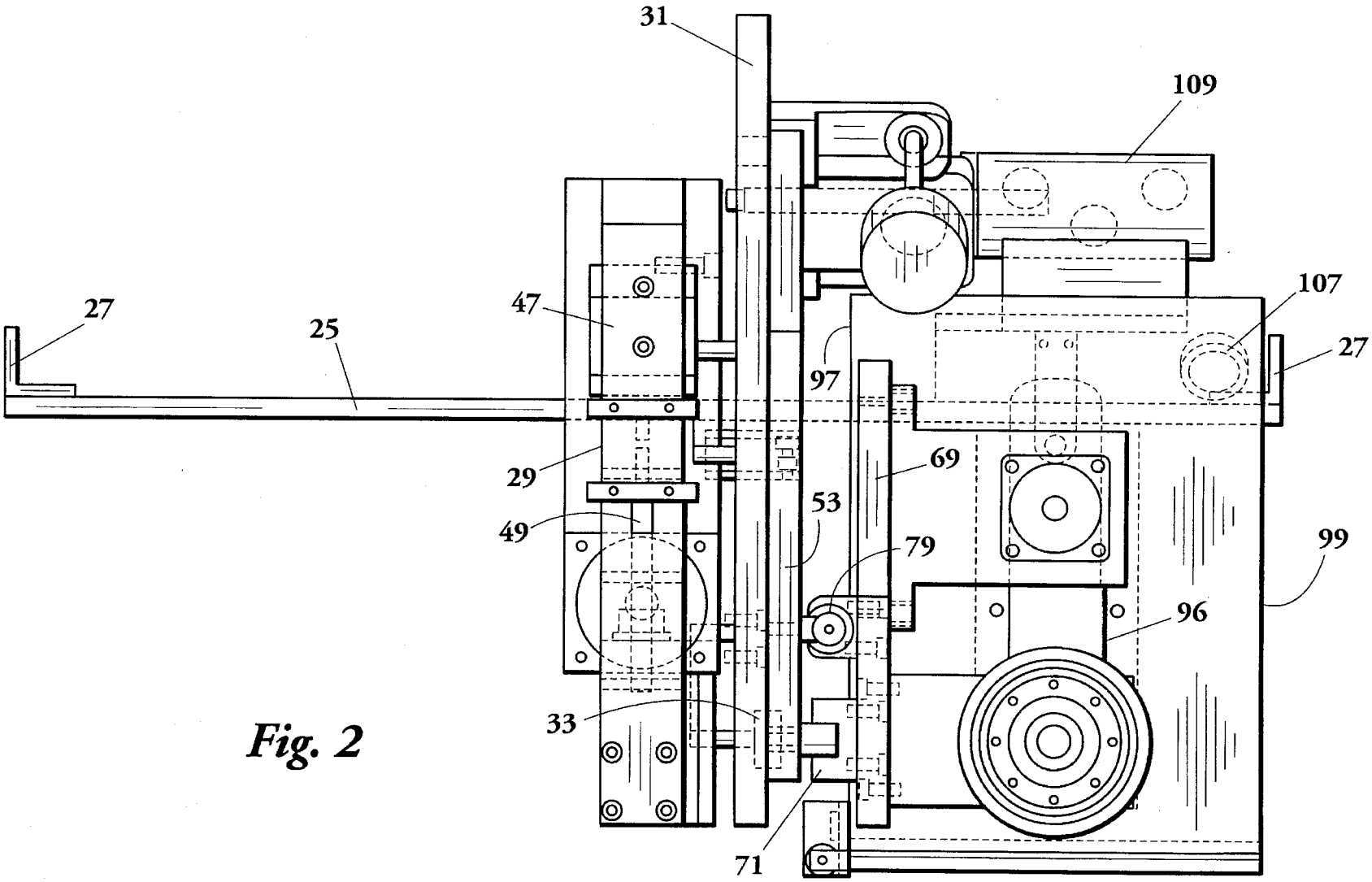
FIG. 2 is a wire frame top plan view of the supporting structure and components of a preferred embodiment of one finer/polisher to be mounted in the console of FIG. 1.
Figure 3:
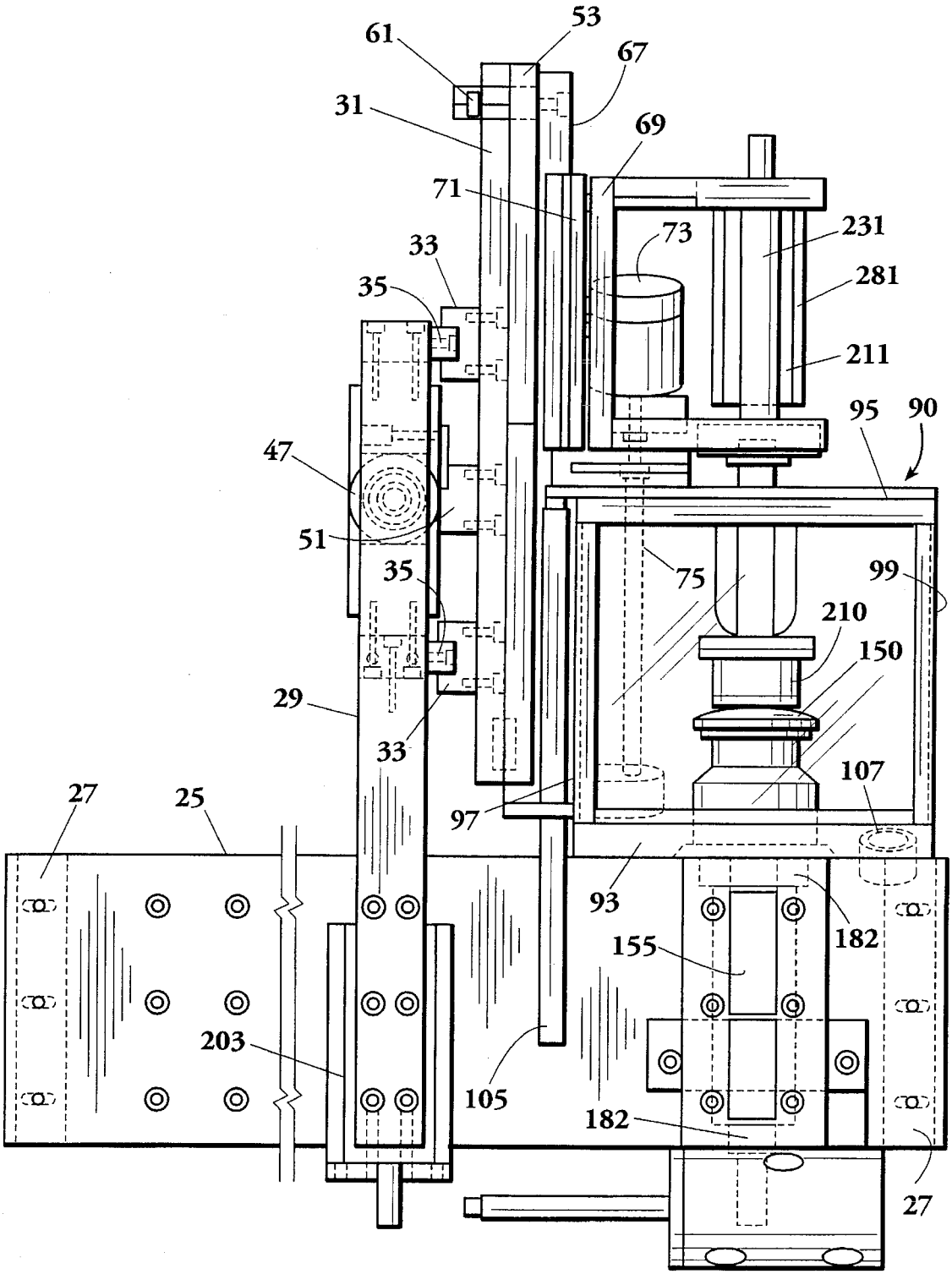
FIG. 3 is a wire frame front elevation view of the support structure and components of FIG. 3.
Figure 4:
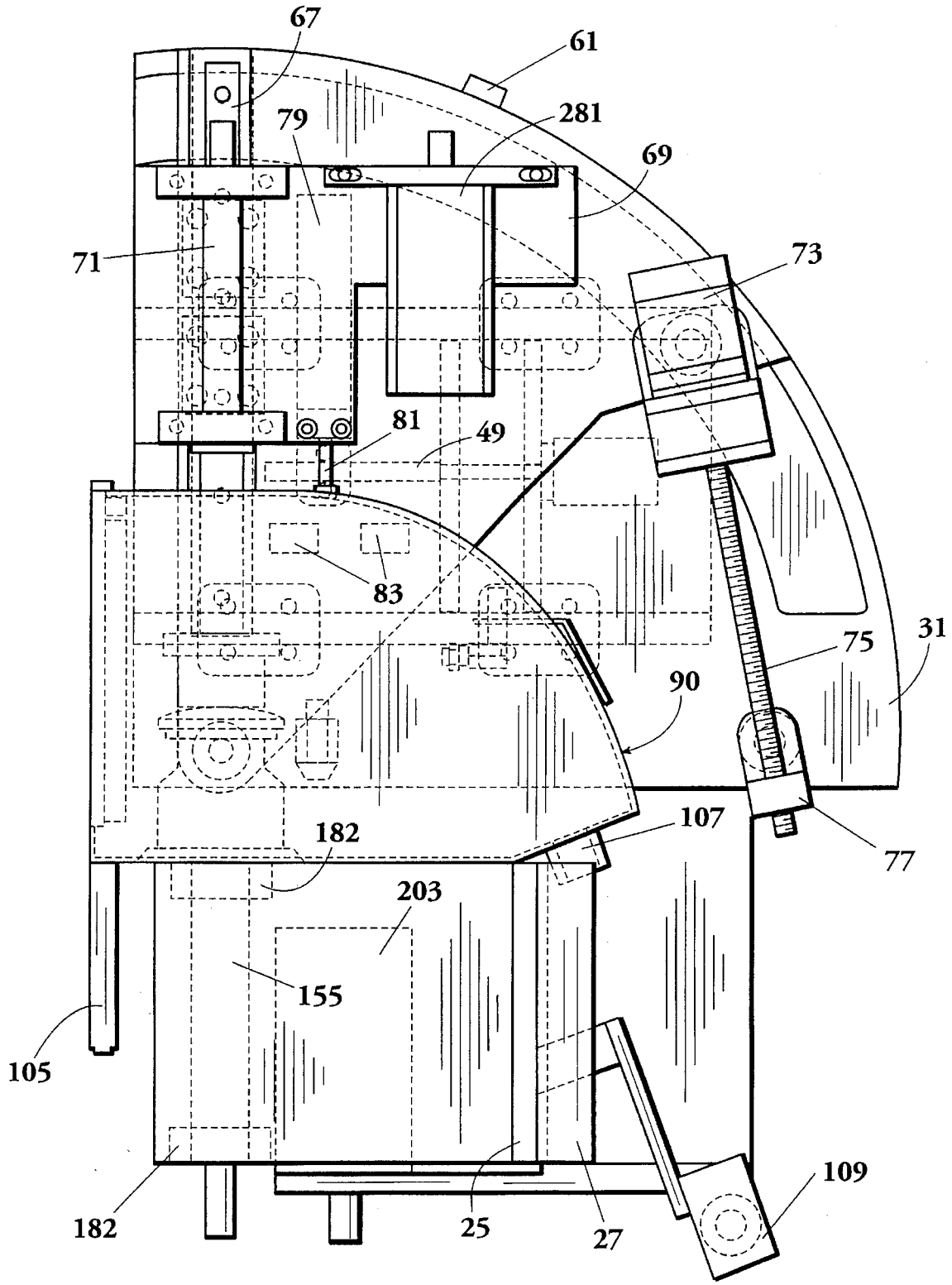
FIG. 4 is a wire frame right side elevation view of the structure and components of the finer/polisher of FIG. 2.

Turning to FIGS. 2, 3 and 4, the fixed internal structure mounted in the console 10 and used to support the various conformal tool components includes a fixed plate 25 secured to the inside side walls of the lower cabinet 11 by use of angle irons 27. A rectangular spine 29 extends transverse to and vertically upwardly from the plate 25 and from front to rear in the console 10.

Figure 5:
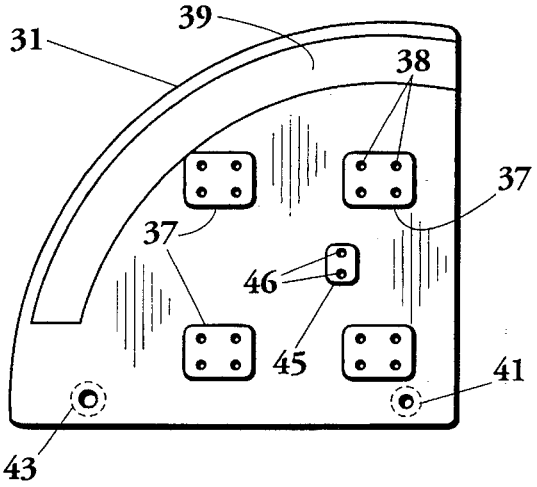
FIG. 5 is a left side elevation of a preferred embodiment of the main sliding plate of the finer/polisher of FIG. 2.
Figure 6:
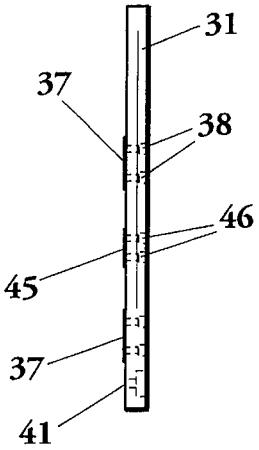
FIG. 6 is a front elevation view of the main sliding plate of FIG. 5.

To permit reciprocal, substantially horizontal, front-to-rear motion of conformal tool components relative to the above described fixed structure, a main sliding plate 31 is mounted on blocks 33. The blocks 33 ride on horizontal guides 35 secured to the spine 29. As can best be seen in FIG. 5 and 6, the main sliding plate 31 is preferably an approximately quarter circle sheet of ¾ inch aluminum. The apex of the main sliding plate is at its lower front as viewed in relation to the console 10. The blocks 33 are mounted on pads 37 on one side of the plate 31 by bolts (not shown) through apertures 38 provided in the pads 37. An arcuate strip of bearing tape 39 extends on the other face of the plate 31 along its arcuate edge. One pivot hole 41 is provided proximate the apex of the plate 31 and another pivot hole 43 proximate the lower arcuate corner of the plate 31. The plate 31 also has another pad 45 and aperture 46 between the upper and lower pairs of pads 37. As seen in FIGS. 3, 4 and 5, the main sliding plate 31 is driven reciprocally forwardly and rearwardly along the guides 35 by a stepping motor 47 mounted on the spine 29 and driving a lead screw 49 threadedly engaged with a bracket 51 secured to the main plate 31 on the center pad 45 by bolts (not shown) through the center pad apertures 46. The forward and rearward limits of motion of the main sliding plate 31 are set by limit switches 83.

Figure 8:
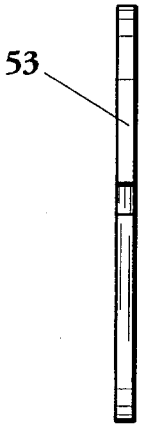
FIG. 8 is a front elevation view of the rotating plate of FIG. 7.
Figure 7:
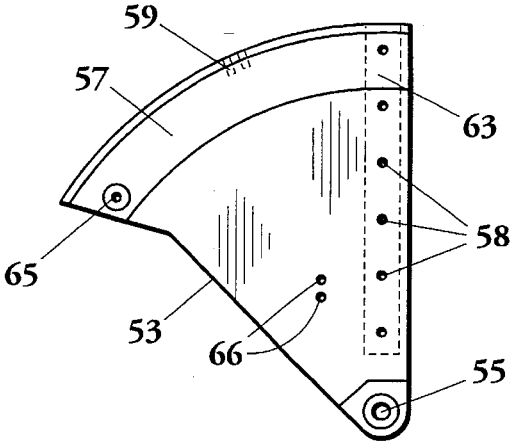
FIG. 7 is a left elevation view of a preferred embodiment of the rotating plate of the finer/polisher of FIG. 2.

Reciprocal, angular positioning of conformal tool components is achieved by use of a rotating plate 53, best illustrated in FIGS. 7 and 8. As shown, the rotating plate 53 is preferably an approximately ⅛ circle of ¾ inch aluminum with a pivot hole 55 at its apex and a bearing island 57 on one face and along its arcuate edge such that, when the main sliding plate apex pivot hole 41 and the rotating plate apex pivot hole 55 are aligned on a common axis, the bearing island 57 on the rotating plate 53 rides on the bearing tape 39 of the main sliding plate 31. Mounting holes 59 are also provided along the arcuate edge of the rotating plate 53 for mounting a roller bracket 61, best seen in FIGS. 2, 3 and 4, on the rotating plate 53. The bracket 61 maintains rotating plate 53 in parallel relationship with the sliding plate 31. A pad 63 on the forward portion of the face of the rotating plate 53 opposite the bearing island 57 extends from approximately the apex pivot hole 55 to the arcuate edge of the rotating plate 53 and has mounting holes 58 therethrough for reasons to be hereinafter explained. Another pivot hole 65 is provided in the rearward arcuate corner of the rotating plate 53. Additional mounting holes 66 are also provided proximate the center of the rotating plate 53. The rotational or angular position of the rotating plate 53 in relation to the main sliding plate 31 is controlled by a stepping motor 73 which drives a lead screw 75 which is in turn threadedly engaged with a bracket 77. The motor 73 is pivotally mounted on the rotating plate 53 at its arcuate corner pivot hole 65 and the bracket 77 is pivotally mounted on the main plate 31 at its pivot arcuate corner hole 43 so that the lead screw 75 and the bracket 77 can maintain proper alignment during the rotation of the rotating plate 53 in relation to the main sliding plate 31. The maximum and minimum limits of angular rotation of the rotating plate 53 are also set by limit switches (not shown).

Figure 10:
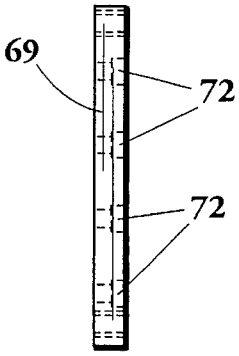
FIG. 10 is a front elevation view of the radial sliding plate of FIG. 9.
Figure 9:
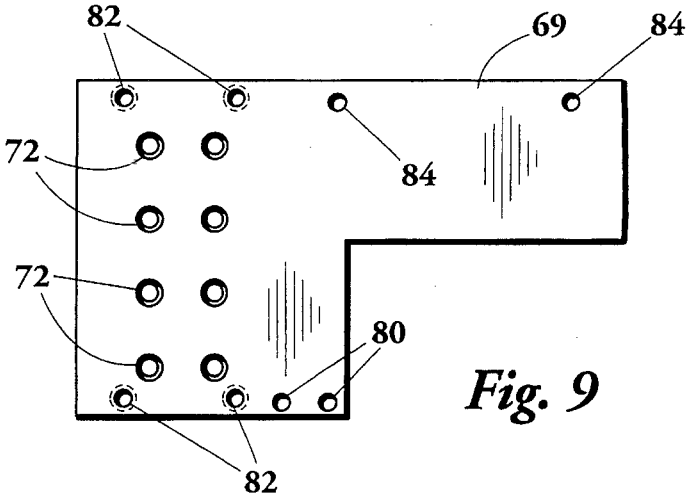
FIG. 9 is a right side elevation view of a preferred embodiment of the radial sliding plate of the finer/polisher of FIG. 2.

To permit relatively radial movement of conformal tool components as compared to the angular movement of the rotating plate 53, a linear guide 67, best seen in FIGS. 3 and 4, is mounted on the rotating plate pad 63 by bolts (not shown) through holes 58 provided in the rotating plate 53. A radial sliding plate 69, preferably an L-shaped piece of ⅝ inch aluminum as shown in greater detail in FIGS. 9 and 10, is slidably engaged with the linear guide 67 by bearing blocks 71 bolted to the plate 69 through holes 72 in the main body of the plate 69. The radial position of the radial sliding plate 69 is controlled by a pneumatic cylinder 79 mounted on the radial sliding plate 69 by use of bolts (not shown) through holes 80 provided in the plate 69. The cylinder rod 81 is connected to the rotating plate 53 by use of bolts (not show) through the central holes 66 therein. The radial sliding plate 69 is also provided with mounting holes 82 and 84 for connection of conformal tool components thereto as will be hereinafter described.

All of the above described fixed and moving structures provide a framework for connection of the conformal tool components so that the position of the conformal tool can be varied in approximately front to rear reciprocating motion, in angular reciprocating motion and in approximately radial reciprocating motion. Any number of alternative structures might be employed to achieve these basic functions and are included within the scope of this disclosure provided these functions are achieved so as to satisfy to the operational requirements of the conformal tool as hereinafter set forth.

Figure 11:
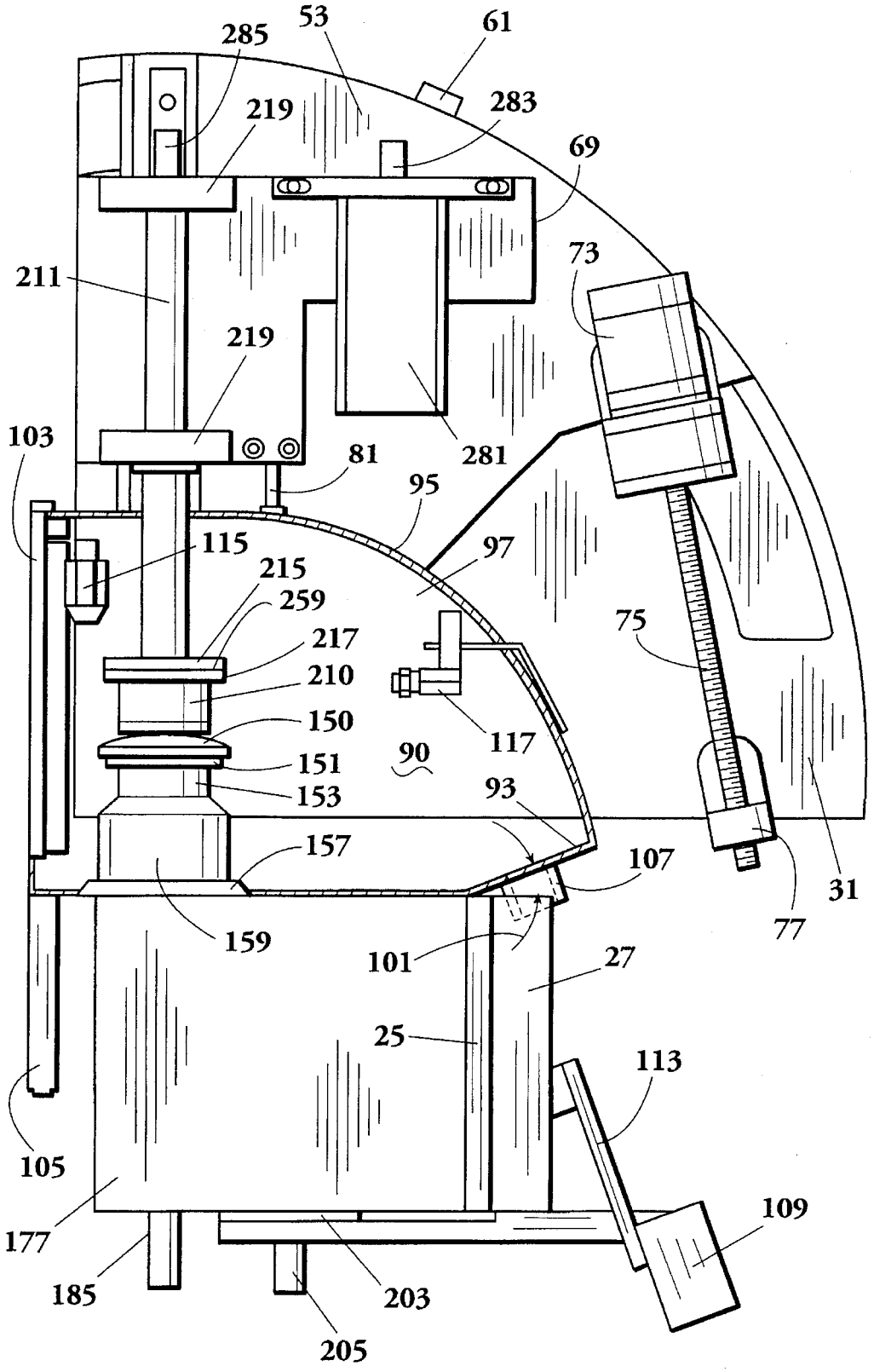
FIG. 11 is a wire frame right side elevation view of selected supporting structure and components of the finer/polisher of FIG. 2.

Turning to FIG. 11, a preferred embodiment of a compartment 90 in which fining/polishing is performed is illustrated in its preferred relationship to the main sliding plate 31, the rotating plate 53 and the radial sliding plate 69. As shown, the radial sliding plate 31 is in its forward- most condition, the rotating plate 53 is in its forward most condition and the radial sliding plate 69 is in its lower-most condition. The compartment 90 has a base 91, an upwardly angled back portion 93 and a curved top portion 95, all between parallel side walls 97 and 99. The compartment 90 is rigidly fixed in relation to the main plate 25 so that the main sliding plate 31, the rotating plate 53 and radial sliding plate 69 all move in relation to the compartment 90. Preferably, the compartment back plate 93 angles upwardly at an angle 101 of approximately 20 degrees in relation to the base 91 so that when mounted in the console 10, the above described fixed and moving structures will be tilted rearwardly and the back portion 93 will be in a horizontal condition. Front physical and visual access to the compartment 90 is through a vertically sliding, transparent door 103, preferably of Lexan, reciprocated by a pneumatic cylinder 105.

Figure 12:
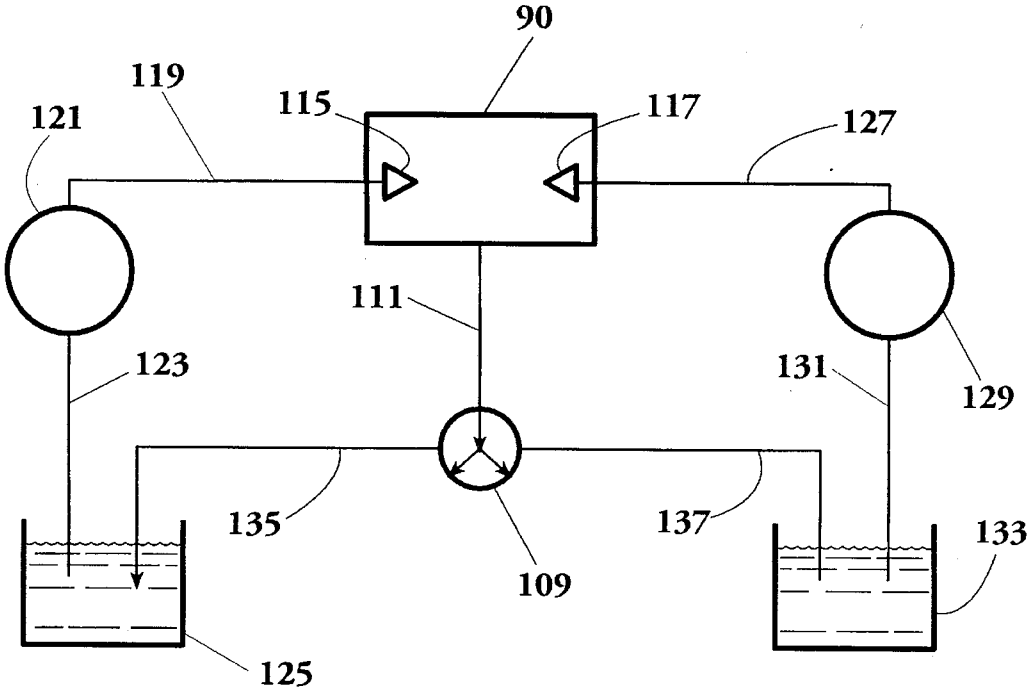
FIG. 12 is a schematic diagram of a preferred embodiment of the slurry/rinse fluid system of the finer/polisher.

Looking at FIGS. 11 and 12, a drain 107 through the back portion 93 of the compartment is connected to a computer operated valve 109 by a section of hose 111. The valve 109 is connected to the main plate 25 by a bracket 113. The compartment 90 has a slurry nozzle 115 in its forward portion and a rinse nozzle 117 in its rearward portion. The slurry nozzle 115 is series connected through a section of hose 119, a slurry pump 121 and another section of hose 123 to a slurry reservoir 125 seated in the bottom of the console 10. Similarly, the rinse nozzle 117 is series connected through a hose 127, a fluid pump 129 and another hose 131 to a fluid reservoir 133 in the bottom of the console 10. The valve 109 has one outlet connected through a hose 135 to the slurry reservoir 125 and another outlet connected through a base 137 to the rinse fluid reservoir 133.

As shown in FIGS. 3, 4 and 11, a typical lens 150 which is to be fined or polished by a conformal tool 210 in accordance with the present invention is adhered to a typical lens block 151 for mounting on the lens rotating assembly of the finer/polisher. This assembly includes a chuck 153, a spindle 155, a seal 157 and a slinger 159.

Figure 13:
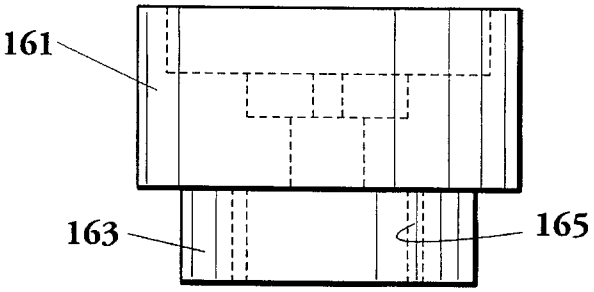
FIG. 13 is an elevation view of a preferred embodiment of the chuck of the finer/polisher.
Figure 14:
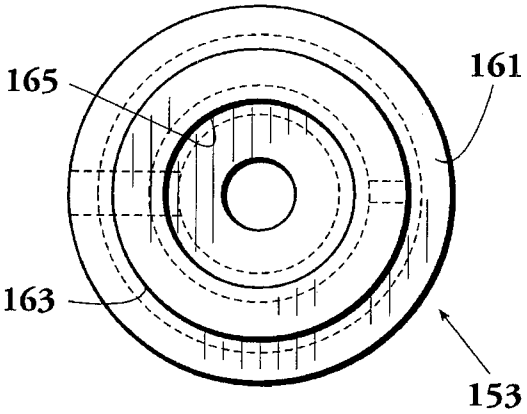
FIG. 14 is a bottom plan view of the chuck of FIG. 13.
Figure 19:
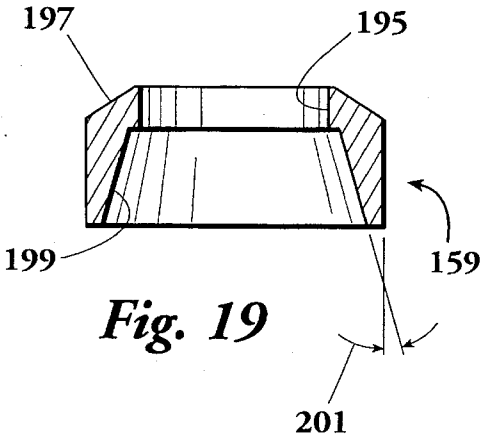
FIG. 19 is an elevation view of a preferred embodiment of the slinger of the finer/polisher.
Figure 20:
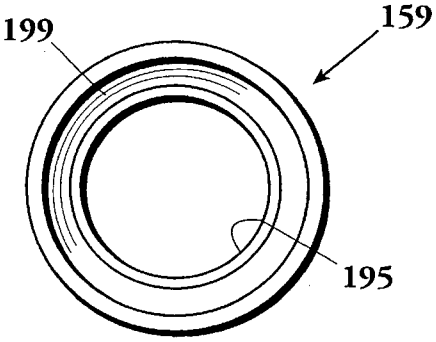
FIG. 20 is a bottom plan view of the slinger of FIG. 19.
Figure 17:
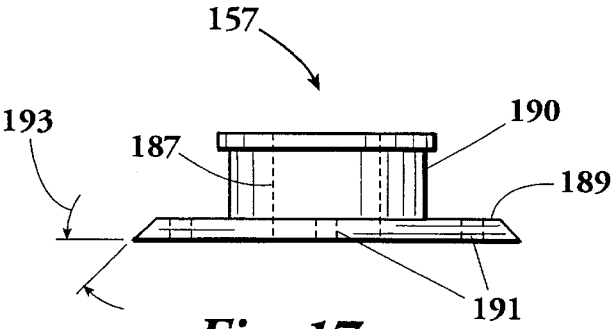
FIG. 17 is an elevation view of a preferred embodiment of the seal of the finer/polisher.
Figure 18:
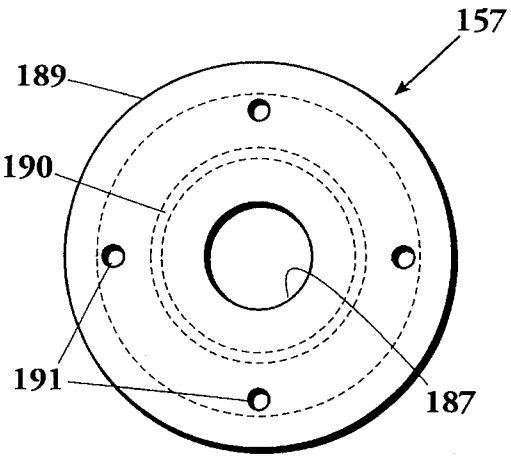
FIG. 18 is a bottom plan view of the seal of FIG. 17.
Figure 15:
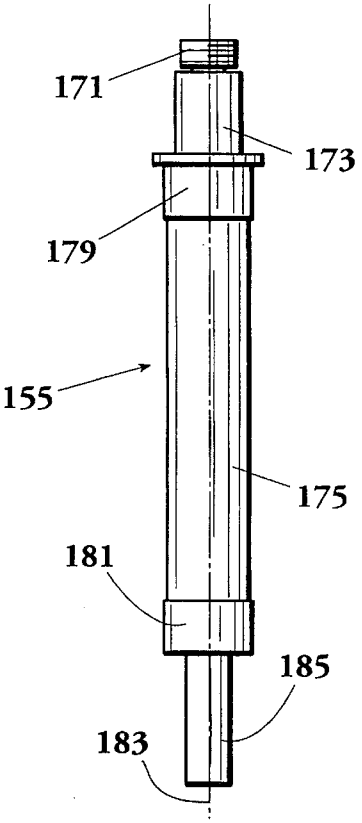
FIG. 15 is an elevation view of a preferred embodiment of the lens spindle of the finer/polisher.
Figure 16:
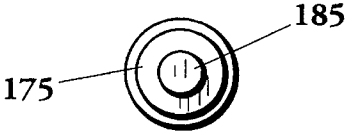
FIG. 16 is a bottom plan view of the lens spindle of FIG. 15.

A preferred embodiment of the chuck 153 is illustrated in FIGS. 13 and 14. The chuck 153 is preferably aluminum and includes an upper portion 161 adapted for detachable engagement with the block 151 and a lower portion 163 with an internal thread 165 for engagement with the spindle 155. A preferred embodiment of the lens spindle 155 is illustrated in FIGS. 15 and 16. A threaded end 171 on its upper portion 173 extends into the compartment 90 and is engaged with the chuck 153. The main body 175 of the spindle 155 extends downwardly from the compartment 90 into a housing 177 where it is journalled at 179 and 181 on bearings 182 for rotation about its axis 183. The lower end 185 of the lens spindle 155 extends beneath the housing 177. The lens spindle 155 is preferably stainless steel. The seal 157, a preferred embodiment of which is illustrated in FIGS. 17 and 18, is made of aluminum and is mounted on the lens spindle 155 through a bore 187 in the seal 157. The base 189 of the seal 157 is bolted to the base 91 of the compartment 90 through mounting holes 191 and the upper portion 190 of the seal 157 extends upwardly from the base 189. The outer edges of the seal base 189 are preferably tapered at an angle 193 of approximately 45 degrees. The slinger 159, a preferred embodiment of which is illustrated in FIGS. 19 and 20, is seated over the upper portion and on the base 189 of the seal 157, with the lens spindle 155 extending through a bore 195 in the slinger 159. The upper edge 197 of the slinger 159 is beveled and the interior walls 199 of the slinger 159 are tapered at an angle 201 of approximately 15 degrees. Preferably, the slinger 159 will be made of Delrin. The lens spindle 155 is driven by a variable speed reversing motor 203 having its shaft 205 connected to a pulley (not shown) on the lower end 185 of the lens spindle 155 by a belt (not shown).

Figure 23:
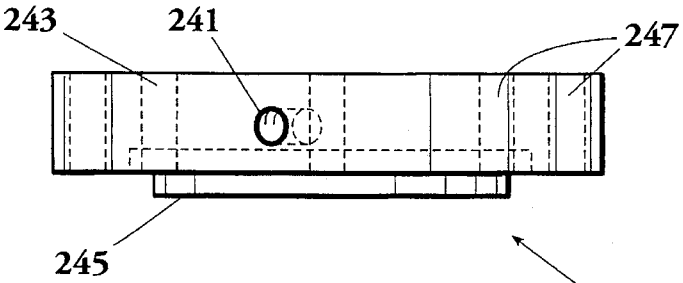
FIG. 23 is an elevation view of a preferred embodiment of the back plate of the finer/polisher.
Figure 24:
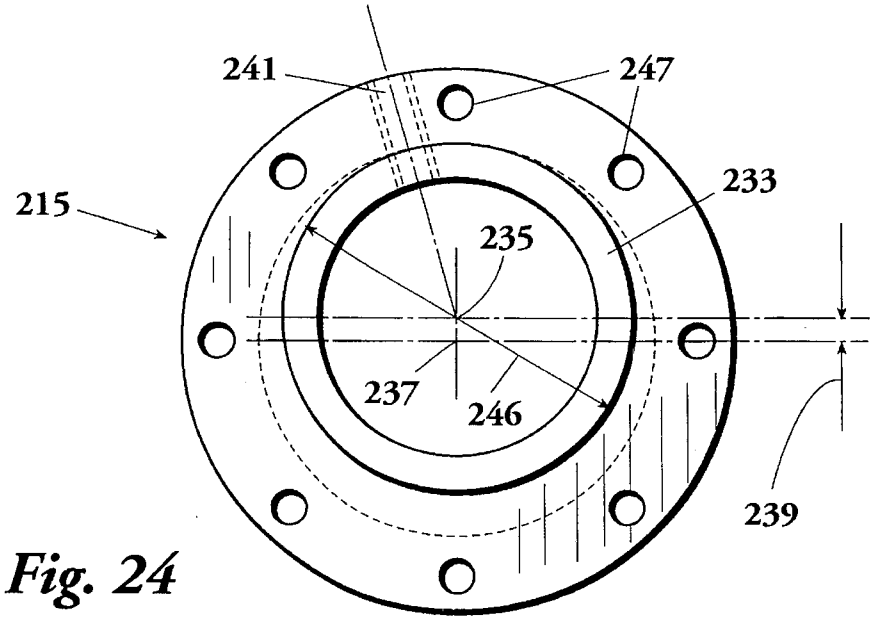
FIG. 24 is a bottom plan view of the back plate disc of FIG. 23.
Figure 21:
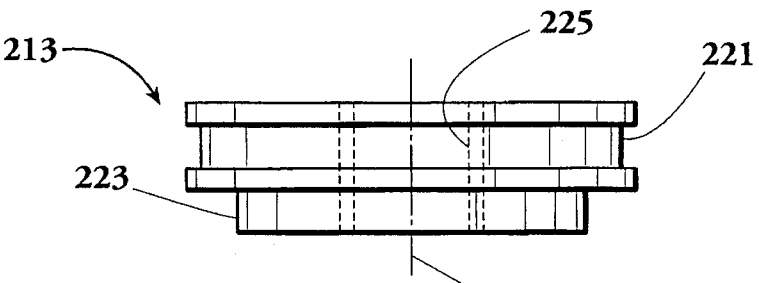
FIG. 21 is an elevation view of a preferred embodiment of the offset of the finer/polisher.
Figure 22:
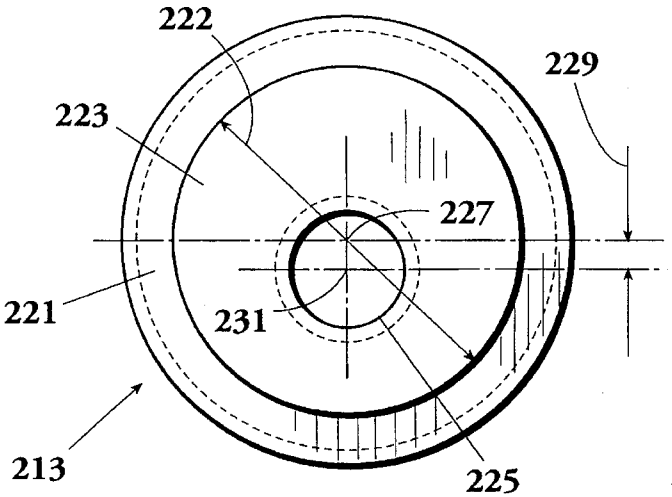
FIG. 22 is a bottom plan view of the offset disc of FIG. 21.
Figure 26:
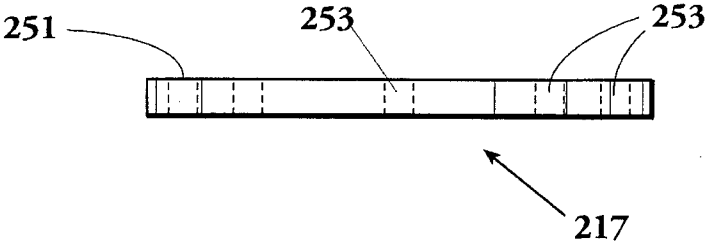
FIG. 26 is an elevation view of the mounting ring of FIG. 25.
Figure 25:
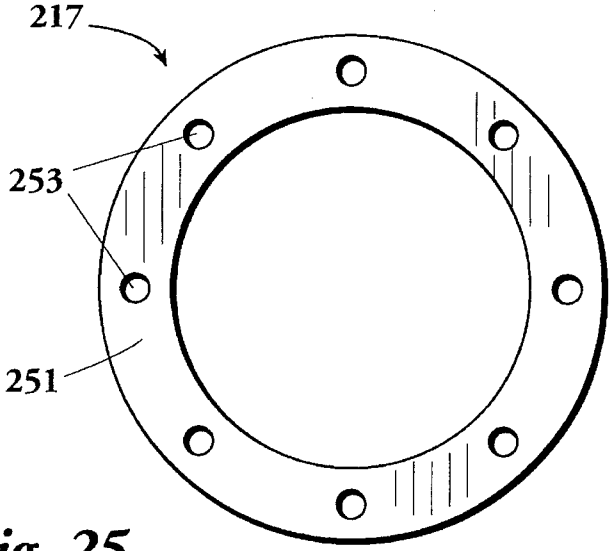
FIG. 25 is a top plan view of a preferred embodiment of the mounting ring of the finer/polisher.

As shown in FIGS. 3, 4 and 11, the conformal tool 210 is mounted on an assembly which includes a tool spindle 211, a tool offset 213, a back plate or disc 215 and a mounting ring 217. The tool spindle 211, preferably of stainless steel, is journalled on the radial sliding plate 69 by bearings 219 with the lower portion of the spindle 211 extending into the compartment 90 through a slot 96 in the top 95 of the compartment 90. The slot 96 extends from proximate the front toward the rear of the compartment 90 and permits the tool assembly to pivot in the compartment 90 when the rotating plate 53 is angularly repositioned. Preferably, the slot 96 is sealed around the tool assembly by a slotted flexible gasket (not shown) to prevent escape of fluid and debris from the slot 96 during operation. The lower end of the tool spindle 211 is threadedly engaged to the offset 213, a preferred embodiment of which is illustrated in FIGS. 21 and 22. As shown, the offset 213 is a ¾ inch aluminum disc with an upper portion 221 of greater diameter than the diameter 222 of its lower portion 223. A threaded opening 225 through the offset 213 is offset from the center 227 of the offset 213, preferably by a distance 229 of ⅛ inch. Thus, as the tool spindle 211 rotates about its axis 231, the center 227 of the offset 213 orbits around the axis 231. The lower portion 223 of the offset 213 fits snugly into a circular seat or bore 233 in the back plate 215. A preferred embodiment of the back plate 215 is shown in FIGS. 23 and 24. The seat 233 has its center 235 offset from the back plate center 237 by a distance 239 equal to the offset distance 229 in the offset 213. The back plate 215 is secured to the offset 213 by use of a set screw (not shown) threaded into a set screw aperture 241 extending radially through the upper portion 243 of the back plate 215 from its outer wall into the seat 233. The back plate 215 has a lower portion 245 of diameter 246 less than the diameter of its upper portion 233 for reasons to be hereinafter explained. The back plate 215 is also provided with a plurality of apertures 247 spaced along its perimeter, also for reasons to be hereinafter explained. The mounting ring 217 is used to secure the tool 210 against the back plate 215. A preferred embodiment of the mounting ring 217 is illustrated in FIGS. 25 and 26 and consists of a circular flange 251 with a plurality of apertures 253 spaced at intervals along the flange 251 for alignment with the apertures 247 in the back plate 215. The mounting ring 217 is preferably made of aluminum.

Figure 28:
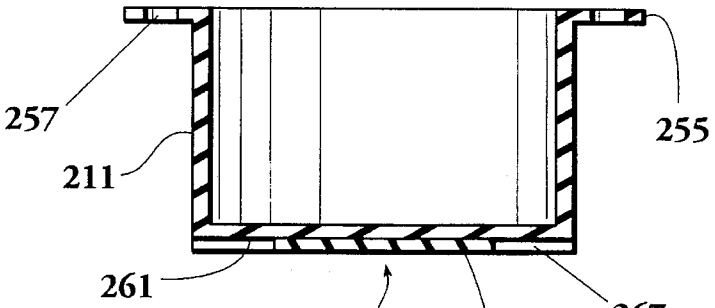
FIG. 28 is an elevation view of the conformal tool and pad of FIG. 27.
Figure 27:
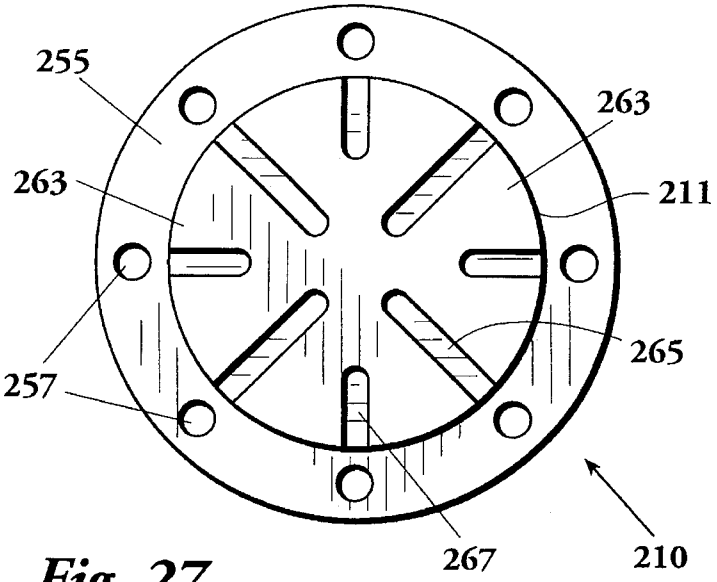
FIG. 27 is a bottom plan view of a preferred embodiment of the conformal tool and pad of the finer/polisher.

Turning now to FIGS. 27 and 28, a preferred embodiment of the conformal tool 210 is illustrated. The tool 210 has a pliant casing 211 preferably formed of Neoprene with a Dacron backing and substantially in the shape of a top hat. The brim or flange 255 of the casing 211 has a plurality of spaced apart apertures 257 through it so that the flange 255 can be sandwiched between the back plate 215 and the mounting ring 217 with the apertures aligned. The casing 211 will preferably be filled with a conformable filler such as glass beads or other suitable material such as water, grease or oil, depending upon the required compliance of the casing 211. Use of glass beads affords not only global compliance of the casing 211 to the lens 150 but also provides a local conformance not otherwise achieved with other fillers. Preferably, a flat Neoprene cover or seal 259, as can best be seen in FIG. 11, covers the open portion of the casing 211 and is also compressed between the back plate 215 and the mounting ring 217 to secure the filling material (not shown) in the casing 211. The lower portion 245 of the back plate 215 serves to tightly stretch the casing brim 255 and the pliant cover 258 to seal the filling in the casing 211. A separate elastomer pad 260, preferably with an adhesive backing, is removably applied to the base 261 of the casing 211. If the pad 260 is to be used for fining, it will preferably have an abrasive surface such as silicone carbide grit for removing tool marks and cutting and machine marks. For polishing, the pad 260 will preferably be of non-woven fabric, perhaps felt, and finer grit will be contained in the slurry sprayed on the lens during polishing. For example, a fining pad might have a 3 to 20 micron grit surface while the polishing slurry might typically contain 2 micron grit. As is best seen in FIG. 27, the pad 260 preferably has a plurality of radially aligned slots defining fingers 263 of the pad 260. In the preferred embodiment shown, alternating long 265 and short 267 slots define eight fingers 263 on the pad 260.

Figure 29:
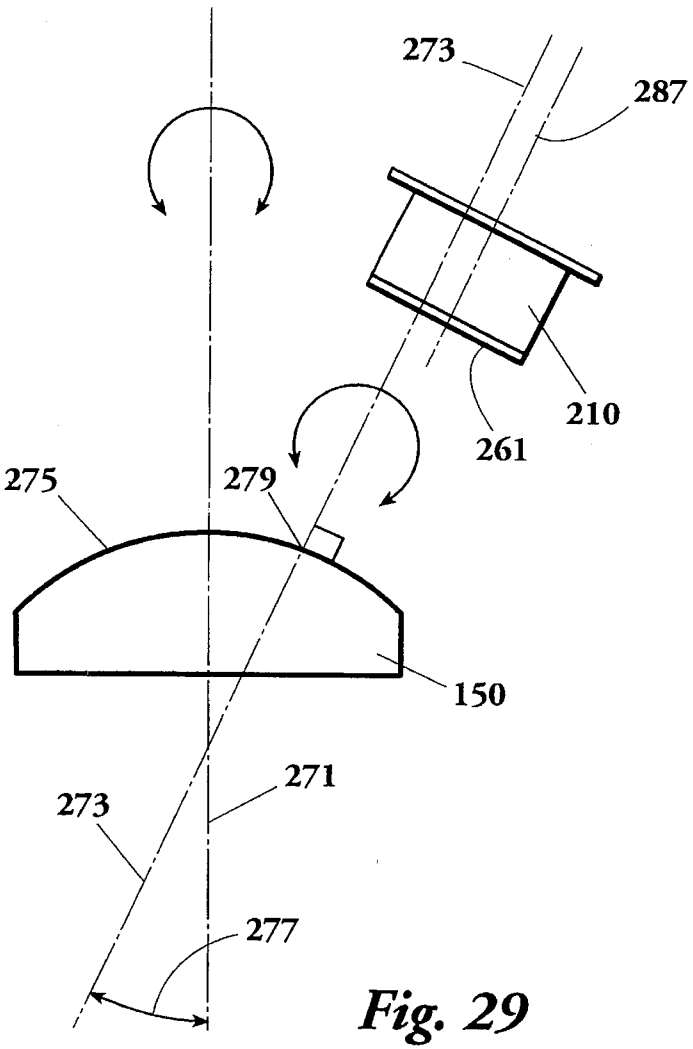
FIG. 29 is a diagrammatic illustration of the interrelationship of the axes of the tool and lens of the finer/polisher.

Turning now to FIG. 29, the functions of the main sliding plate 31, the rotating plate 53 and the radial sliding plate 69 in relation to the alignment of the lens 150 with the conformal tool 210 can be understood. The lens 150 is rotated about a fixed axis 271 substantially transverse to the lens 150 which coincides with the longitudinal axis 183 of the lens spindle 155 as shown in FIG. 15. In the preferred fining/polishing operation, the base 261 of the tool 210 will be aligned on an axis 273 substantially normal to the lens face 275 to be polished/fined. The angular relationship 277 between the lens rotational axis 271 and the tool rotational axis 273 is established by the angular position of the rotating plate 53. The point of intersection 279 of the tool rotation axis 273 with the lens face 275 to be fined/polished is determined by the horizontal position of the main sliding plate 31. Finally, contact between the tool 210 and the lens 150 is controlled by the positioning of the radial sliding plate 69. The lens 150 can be rotated in either direction about its axis 271 and at any selected rpm by the reversible variable speed lens motor 203. Similarly, the tool 210 may be rotated in either direction about its axis 273 at any selected rpm by the reversing variable speed tool motor 281, the shaft 283 of which is connected by a belt (not shown) to the end 285 of the tool spindle 211. The tool motor 281 is mounted on the radial sliding plate 69 for simultaneous movement with the tool spindle 211 by bolts (not shown) through the mounting holes 84 provided in the radial sliding plate 69. The lens 150 and the tool 210 may be rotated in opposite or similar directions depending on the desired abrasive result. While their speeds will normally remain constant during a given polishing/fining operation, the speeds could be varied during operation. The tool 210 will normally be mounted with its axial center 287 eccentrically offset with respect to the axis of rotation 273 of the tool spindle 211. The eccentric relationship of the tool 210 is manually adjustable by loosening the set screw (not shown) in the back plate 215 and rotating the offset 213 in relation to the back plate 215. If, for example, as shown in FIGS. 22 and 24, the offset distances in the offset 213 and the back plate 215 are each ⅛ inch, then the eccentricity can be varied from 0 inches to ¼ inch.

The cylinder 79 which reciprocates the radial sliding plate 69 also controls the pressure applied by the tool 210 to the lens 150. The limit switches 83 associated with the main sliding plate 31 and the limit switches (not shown) associated with the rotating plate 53 also provide a homing position for setting the data reference points for a computer program that will control the positioning of the tool 210 in relation to the lens 150.

Figure 30:
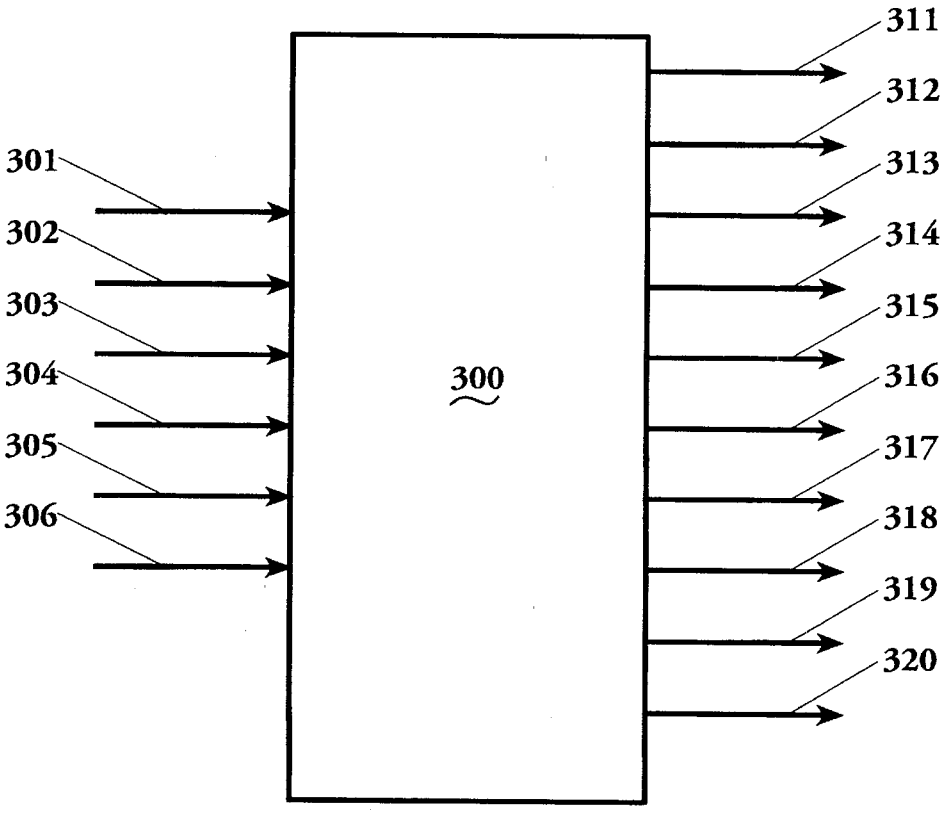
FIG. 30 is a block diagram illustrating a preferred embodiment of the inputs and outputs of the computer in the finer/polisher.
Figure 31:
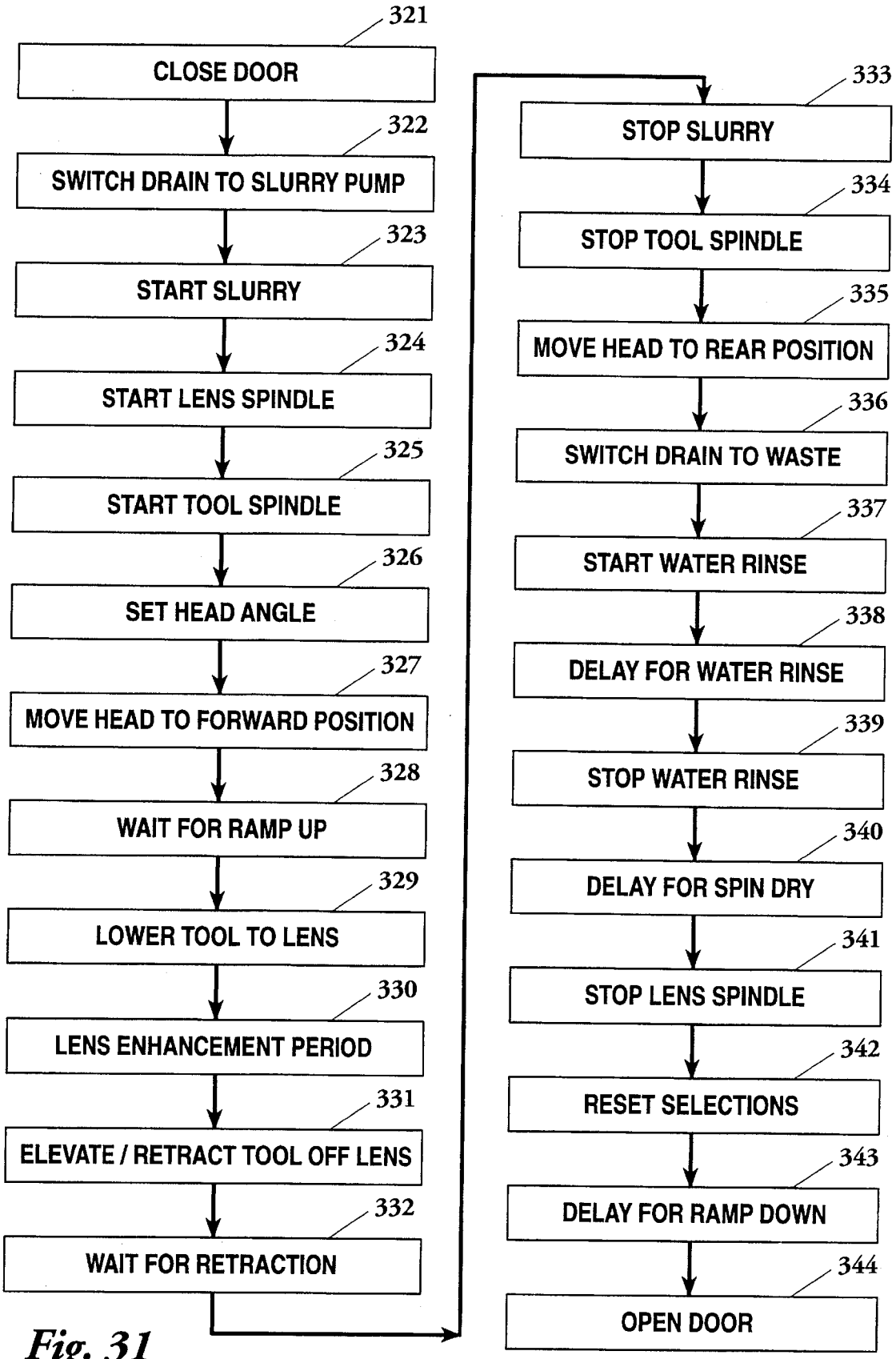
FIG. 31 is a flow diagram illustrating the steps of a preferred polisihing process for the operation of the finer/polisher by the computer of FIG. 30.

Turning now to FIGS. 30 and 31, the computer controlled operation of the conformal tool 210 can be understood. The computer 300 controlling the operation of the finer/polisher is mounted in the console 10 and preferably has at least the following inputs and outputs:

A: INPUTS:

301 Door 103 open/close status sensor;

302 Emergency stop 23 hit button on console 10;

303 Material and range parameters selected by depression of one button in each of groups 19 and 21;

304 Abort cycle by depression of any button in either of groups 19 and 21;

305 Home limit switch 83 for horizontal stepper motor 47;

307 Home limit switch (not shown) for headangle stepper motor 73.

B. OUTPUTS:

311 Illuminate selected material 19 and range 21 buttons on console 10;

312 Solenoid for operation of cylinder 105 of door 103;

313 Solenoid for operation of cylinder 110 of drain 109;

314 Solenoid for operation of rinse fluid pump 129;

315 Solenoid for operation of slurry pump 121;

316 Servo on for lens spindle 155;

317 Servo on for tool spindle 211;

318 Air pressure switch for tool radial sliding plate 69;

319 Tool horizontal position stepper motor 47 on; and

320 Tool head dangle stepper motor 73 on.

As shown in FIG. 30, the computer 300 memory preferably stores data respecting appropriate speed of the lens spindle 155, the location of the tool 210 in relation to its horizontal displacement from the lens spindle axis 271 which is accomplished by the main sliding plate 31 being driven by the horizontal stepper motor 37, the angular position 277 of the tool spindle axis 273 in relation to the lens spindle axis 271 which is accomplished by the rotating plate 53 being driven by the rotating stepping motor 73, the speed of the tool spindle 211, the tool oscillation included angle and the lens enhancement period or duration of operation of the finer/polisher. The sets of buttons 19 and 21 on the console are respectively for the selection of lens material, type and/or range. That is, each button of a group 19 or 21 may represent a different lens material, a different lens type (e.g. spherical, aspherical and special) or high, mid and low range lens curvatures. Selection of one button from the first group 19 and another button from the second group 21 selects the parameters to be applied in a given fining/polishing operation. In addition, the memory of the computer 300 also stores information respecting the particular machine with which it is associated independent of the lens itself. Such data would preferably include the time delay allowed for the lens spindle 155 and/or the tool spindle 211 to ramp up to and down from speed. In addition, delay times for tool retraction, time for operation of the rinse fluid pump 129 and time for spinning of the lens spindle 155 at maximum rpm for drying the lens 150 after rinsing may be included.

The step-by-step operation of the finer/polisher will now be explained. After the operator has manually loaded the lens 150 with its block 151 into the compartment 90 and on the chuck 153 and has adhered a finer/polisher pad 260 to the base 261 of the tool 210, the operator manually selects two buttons, one from each of the groups 19 and 21 on the front of the console 10 indicative of the style, material and/or range of the lens 150 to be fined/polished. The selected buttons will preferably be illuminated upon pressing to provide visual confirmation that the appropriate selection has been made. The automatic cycle of the finer/polisher is then initiated by the computer 300. This automatic operation is illustrated in FIG. 31 with respect to the polishing process. In step 321, the door 103 of the compartment 90 is closed by operation of the door cylinder 105. At step 322 the valve 109 is operated to allow the drain 107 to flow to the slurry reservoir 125. In step 323, the slurry pump 121 is energized to initiate the flow of slurry through the slurry nozzle 115. The slurry nozzle 115 is directed at the surface of the lens 150 to be fined/polished to feed micro abrasive suspension and cool the lens 150 and wash the tool pad 260. After the slurry has started, operation of the lens spindle motor 203 is initiated in step 324 and in step 325, operation of the tool spindle motor 281 is initiated. As the lens spindle 155 and the tool spindle 211 come to speed, the head angle of the tool 210 is set in step 326 by operation of the rotating plate stepping motor 73 which drives the rotating plate 53 to bring the tool 210 into proper angular position. In step 327, the head position of the tool 210 is adjusted by operation of the main sliding plate stepping motor 47 which drives the main sliding plate 31 to move the tool 210 into its proper horizontal displacement position from the lens spindle axis 271. In step 328 a ramp up delay time is provided to assure that the slurry is being applied to the lens 150 and/or that the spindles 155 and 211 are up to speed. In step 329, operation of the cylinder 79 is initiated to drive the radial sliding plate 69 and lower the tool 210 into contact with the lens 150. In step 330, the polishing/fining operation takes place for a predetermined period of time. In step 331, the cylinder 79 is oppositely driven as in step 329 to elevate or retract the tool 210 from the lens 150. In step 332 a delay time is established to permit completion of retraction of the tool 210. In step 333 the slurry pump 121 is de-energized to stop the dispersion of slurry on the lens 150. In step 334, the tool spindle motor 281 is de-energized to stop rotation of the tool. In step 335, the main sliding plate stepping motor 47 is operated to drive the main sliding plate 31 rearwardly and thus move the tool 210 toward a rear position in the compartment 90. In step 336, the drain valve 109 is switched to the waste or rinse condition. In step 337, the rinse fluid pump 129 is energized to disperse water through the rinse nozzle 117 to rinse both the lens 150 and the compartment viewing door 103. In step 338, the duration of the rinse step is set. In step 339, the rinse fluid pump 129 is de-energized to stop the flow of rinse fluid through the rinse nozzle 117. In step 340, a delay occurs to permit the lens spindle 155 to come to maximum rpm to spin dry the lens 150. In step 341, the lens spindle motor 203 is de-energized to stop rotation of the lens spindle 155. In step 342, the illuminated buttons on the front face of the console 10 flash to indicate that the fining/polishing cycle has been completed and the reset selections have been returned to their idle state. In step 343, a final delay period is allowed for all functions to ramp down. Finally, in step 344, the compartment door 103 is opened to permit removal of the lens 150 and the block 151. During the automatic cycle, the emergency stop button 23 can be manually operated to stop the cycle at any time, such as if the compartment door 103 should not be fully down in the closed position. Likewise, the depression of any button in groups 19 and 21 will also abort the cycle.

The fining process is in all respects similar to the polishing process of FIG. 31 except that another fluid, likely water, will be used instead of slurry.

The eccentric relationship of the center line 287 of the tool 210 in relation to the center line 273 of the tool spindle 211 affords a breaking up action on the surface of the lens 150. That is, since the rotation of the tool 210 is not consistent about a single axis on the lens 150, abrasive contact is not focused on the same circular path on the lens 150 at all times. This provides more uniformity in fining/polishing.

The displacement between the tool 210 and the lens spindle axis 271 can be oscillated by reciprocating motion of the main sliding plate 31 on its horizontal guides 35. This reciprocating movement can be used to accomplish the same purpose as the eccentricity of the tool axis 287. Similar results can also be achieved by the angular reciprocation of the rotation plate 69. Any one or any combination of these three oscillatory and/or reciprocating actions can be simultaneously employed.

In addition to the above described oscillatory and/or reciprocating motions, changes in the position of the tool axis 287 may also be made during the course of a single fining/polishing operation for the purpose of contouring the tool 210 to the changing curvatures of the lens. Such a variation would most likely be employed in the fining/polishing of a toric lens. Furthermore, co-rotating lens and tool spindles 155 and 211 will provide a more polishing effect on a lens 150 while counter-rotating lens and tool spindles 155 and 211 will produce a more aggressive, abrasive effect.

The slots 265 and 267 in the pad 260 applied to the tool 210 allow slurry or rinsing fluid to constantly penetrate between the tool 210 and the lens 150 so as to maintain the cooling and washing effect throughout the fining/polishing process. Furthermore, the fingers 263 defined by the slots 265 and 267 give the pad 260 a greater flexibility so as to enhance the integrity of conformance of the pad 260 to the lens 150. The positioning of the lens 150 below rather than above the tool 210 and the surface to be fined/polished facing upwardly further assures that fluid will remain on the lens surface throughout the process and also that the tool 210 will be gravitationally aided into conformance with the lens 150.

While in the preferred embodiment shown, a lens 150 is shown with its convex or front face 275 in position for fining/polishing, the above described equipment and process could be applied to fine/polish the concave or back face of a lens as well.

As herein described, the finer/polisher components are to be mounted in the right opening 17 of the console 10. In the two compartment console 10, the finer/polisher components for the left opening 15 would generally be opposite hand to the components described, as will be obvious to those skilled in the art. In a polishing/fining console 10 having two compartments 90, polishing can be done on one side and fining on the other. Alternatively, the same compartment could be used for both fining and polishing a lens 150 without removing the lens 150 from its spindle 155.

The upward extension of the seal upper portion 190 into the slinger 159, together with the angular relationship of the slinger walls 199, prevents slurry or rinsing fluid that drips or moves downwardly along the lens 150 and the slinger 159 from escaping from the compartment 90 because the fluid would have to rise upwardly inside the slinger 159 and over the seal 157 if it were going to escape from the compartment 90.

Thus, it is apparent that there has been provided, in accordance with the invention, a process and apparatus that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An apparatus for fining/polishing an ophthalmic lens comprising:

a spindle;

a pliant casing containing a conformable filler therein and having a flange about a rim thereof;

disc means eccentrically connected to said spindle for rotation therewith; and ring means clamping said casing flange to said disc means for rotation therewith; a fining/polishing surface applied to said casing for rotation therewith, said filler contouring said fining/polishing surface to a surface of the lens to be fined/polished.

2. An apparatus for fining/polishing an ophthalmic lens comprising:

a spindle;

a pliant casing containing a conformable filler therein and having a flange about a rim thereof;

disc means eccentrically connected to said spindle for rotation therewith;

ring means clamping said casing flange to said disc means for rotation therewith; and a pliant pad adhered to said casing for rotation therewith, said pad having a plurality of slots extending from a perimeter toward a center thereof defining a plurality of fingers therebetween, said filler contouring said pad and said fingers thereof to a surface of the lens to be fined/polished.

3. An apparatus according to claim 2 further comprising a pliant cover clamped between said disc means and said flange.

4. An apparatus according to claim 2, said disc means comprising a first disc connected to said spindle and a second disc connected to said casing, said second disc having an eccentric bore for snugly receiving said first disc therein whereby rotation of said second disc in relation to said first disc varies an eccentricity of said second disc in relation to said spindle, and means for securing said second disc against rotation relative to said first disc to maintain a selected eccentricity.

5. An apparatus according to claim 2 further comprising means for rotating the lens about a fixed axis substantially transverse thereto.

6. An apparatus according to claim 5, said lens axis being substantially vertical.

7. An apparatus according to claim 6 further comprising means connected to said spindle for rotating said spindle about a fixed axis intersecting the lens and substantially normal to a surface of the lens to be fined/polished.

8. An apparatus according to claim 6, said casing being disposed above the lens.

9. An apparatus according to claim 8 further comprising means for selectively varying a horizontal displacement of said spindle axis in relation to said lens axis.

10. An apparatus tool according to claim 8 further comprising means for selectively varying an angular disposition of said casing spindle axis in relation to said lens axis.

11. An apparatus according to claim 8 further comprising means for selectively varying a radial displacement of said casing in relation to the lens along said spindle axis to bring said pad into and out of abutment with said surface of the lens and to vary a pressure exerted on surface of the lens by said casing.

12. An apparatus according to claim 8 further comprising slurry means for directing a fining/polishing fluid onto said surface of the lens.

13. An apparatus according to claim 12 further comprising rinse means for directing a rinsing fluid onto said surface of the lens.

14. An apparatus according to claim 13, said lens rotating means being adjustable to vary a speed of rotation of the lens.

15. An apparatus according to claim 14, said spindle rotating means being adjustable to vary a speed of rotation of said casing.

16. An apparatus according to claim 15 further comprising computer means for controlling the operation of said apparatus.

17. An apparatus according to claim 16, said computer means controlling a process comprising the steps of:

initiating flow of fining/polishing fluid from said slurry means onto said lens surface to be fined/polished;

initiating rotation of the lens about said lens axis;

initiating rotation of said spindle about said spindle axis;

aligning said angular disposition of said spindle axis to be substantially normal to said surface of the lens at a desired point of intersection of said axis with said lens surface;

displacing said spindle axis horizontally in relation to said lens axis to bring said angularly aligned axis into intersection with said lens surface at said desired point;

displacing said casing radially along said angularly aligned and horizontally displaced axis to bring said pad into abutment with said lens surface at a desired pressure thereagainst to fine/polish said lens surface; and withdrawing said casing radially along said angularly aligned and horizontally displaced axis after a preselected fining/polishing period.

18. An apparatus according to claim 17, said process further comprising the steps of:

stopping said flow of fining/polishing fluid from said slurry means;

stopping rotation of said casing about said spindle axis;

displacing said spindle axis horizontally in relation to said lens axis to distance said casing from said lens surface;

initiating flow of rinse fluid from said rinse means onto said lens surface;

stopping flow of said rinse fluid from said rinse means;

continuing rotation of the lens for a preselected drying period; and stopping rotation of the lens about said lens axis after said preselected drying period.

19. An apparatus according to claim 18 further comprising a compartment enclosing said casing and said lens therein, said compartment having a drain in a bottom portion thereof for discharging said fining/polishing and rinsing fluids therefrom.

20. An apparatus according to claim 19 further comprising a valve receiving fluid discharged from said drain and for switching flow of said discharged fluid between two discrete outlet paths.

21. An apparatus according to claim 20, said valve being controlled by said computer means.

22. An apparatus according to claim 21, said process further comprising the steps of:

switching said valve to one of said outlets before initiating flow of said fining/polishing fluid; and switching said valve to the other of said outlets before initiating flow of said rinsing fluid.

* * * * *